US009945338B2

(12) United States Patent
Zhang et al.

(10) Patent No.: US 9,945,338 B2
(45) Date of Patent: Apr. 17, 2018

(54) METHOD FOR OPERATING A FUEL INJECTION SYSTEM WITH PRESSURE REDUCTION, AND A FUEL INJECTION SYSTEM COMPRISING A FUEL INJECTION VALVE WITH A SERVO VALVE

(71) Applicant: Continental Automotive GmbH, Hannover (DE)

(72) Inventors: Hong Zhang, Tegernheim (DE); Detlev Schöppe, Wenzenbach (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 385 days.

(21) Appl. No.: 14/382,054

(22) PCT Filed: Mar. 18, 2013

(86) PCT No.: PCT/EP2013/055519
§ 371 (c)(1),
(2) Date: Aug. 29, 2014

(87) PCT Pub. No.: WO2013/139723
PCT Pub. Date: Sep. 26, 2013

(65) Prior Publication Data

US 2015/0053181 A1 Feb. 26, 2015

(30) Foreign Application Priority Data

Mar. 19, 2012 (DE) ..... 10 2012 204 252

(51) Int. Cl.
*F02M 51/06* (2006.01)
*F02M 63/02* (2006.01)
(Continued)

(52) U.S. Cl.
CPC ..... *F02M 63/023* (2013.01); *F02D 41/2096* (2013.01); *F02D 41/3872* (2013.01);
(Continued)

(58) Field of Classification Search
CPC .. F02M 63/023; F02M 51/0603; F02M 63/02; F02M 63/0026; F02M 47/027;
(Continued)

(56) References Cited

U.S. PATENT DOCUMENTS 5,483,842 A * 1/1996 Foreman ..... G01L 5/0009 73/581
6,400,066 B1 6/2002 Sumrak et al. ..... 310/346
(Continued)

FOREIGN PATENT DOCUMENTS

CN 101842574 A 9/2010 ..... F02D 35/00
DE 19954023 A1 5/2000 ..... F02D 41/20
(Continued)

OTHER PUBLICATIONS

International Search Report and Written Opinion, Application No. PCT/EP2013/055519, 10 pages, dated Jun. 24, 2013.
(Continued)

*Primary Examiner* — David Hamaoui
(74) *Attorney, Agent, or Firm* — Slayden Grubert Beard PLLC

(57) ABSTRACT

A method for operating a fuel injection system with pressure reduction, and a fuel injection system that includes a fuel injection valve with a servo valve are provided. The method for operating a fuel injection system includes performing a desired pressure reduction in the pressure accumulator using at least one fuel injection valve of the fuel injection system. This is achieved by opening a servo valve in the fuel injection valve, which is opened, during a pressure reduction phase, just wide enough that the actual closing element remains closed and as a result no fuel injection process takes place.

15 Claims, 3 Drawing Sheets

(51) Int. Cl.

| | |
|---|---|
| ***F02D 41/20*** | (2006.01) |
| ***F02M 57/00*** | (2006.01) |
| ***F02D 41/38*** | (2006.01) |
| ***F02M 63/00*** | (2006.01) |
| ***F02M 47/02*** | (2006.01) |

(52) U.S. Cl.
CPC ..... *F02M 47/027* (2013.01); *F02M 51/0603* (2013.01); *F02M 57/005* (2013.01); *F02M 63/0026* (2013.01); *F02M 63/02* (2013.01); *F02M 2200/21* (2013.01); *F02M 2200/244* (2013.01)

(58) Field of Classification Search
CPC ..... F02M 57/005; F02M 2200/244; F02M 2200/21; F02D 41/2096; F02D 41/3872
See application file for complete search history.

(56) References Cited

U.S. PATENT DOCUMENTS

| | | | | |
|---|---|---|---|---|
| 6,837,221 | B2 * | 1/2005 | Crofts | F02M 47/027 123/467 |
| 6,953,158 | B2 * | 10/2005 | Liskow | F02M 51/0603 239/102.2 |
| 7,828,228 | B2 | 11/2010 | Mochizuki et al. | 239/102.2 |
| 8,590,513 | B2 | 11/2013 | Kondo et al. | 123/494 |
| 9,556,839 | B2 * | 1/2017 | Zhang | F02D 41/2096 |
| 2003/0062026 | A1 * | 4/2003 | Boecking | F02D 41/2096 123/446 |
| 2003/0106533 | A1 | 6/2003 | Crofts et al. | 123/446 |
| 2004/0026537 | A1 * | 2/2004 | Boecking | F02M 63/0026 239/533.3 |
| 2004/0149840 | A1 | 8/2004 | Remmels et al. | 239/584 |
| 2009/0179088 | A1 * | 7/2009 | Mochizuki | F02D 41/2096 239/584 |
| 2015/0013647 | A1 * | 1/2015 | Zhang | F02D 41/2096 123/478 |
| 2015/0128910 | A1 * | 5/2015 | Zhang | F02D 41/2096 123/478 |
| 2016/0298563 | A1 * | 10/2016 | Zhang | F02M 63/0026 |

FOREIGN PATENT DOCUMENTS

| | | | | |
|---|---|---|---|---|
| DE | 19905340 | A1 | 8/2000 | F02D 41/20 |
| DE | 10130857 | A1 | 3/2002 | F02D 41/20 |
| DE | 10158547 | A1 | 6/2002 | F02D 41/20 |
| DE | 10129375 | A1 | 1/2003 | F02M 47/02 |
| DE | 10162250 | A1 | 7/2003 | F02M 51/00 |
| DE | 102005014784 | A1 | 10/2006 | F02M 51/06 |
| DE | 102009000133 | A1 | 7/2009 | F02D 41/20 |
| DE | 102009002875 | A1 | 12/2009 | F01M 65/00 |
| JP | 2002371896 | A | 12/2002 | F02D 41/12 |
| JP | 3932887 | B2 | 6/2007 | F02D 1/02 |
| WO | 02/20976 | A1 | 3/2002 | F02D 41/20 |
| WO | 2012/100075 | A1 | 7/2012 | F02M 51/06 |
| WO | 2013/139723 | A1 | 9/2013 | F02D 41/20 |

OTHER PUBLICATIONS

Chinese Office Action, Application No. 201380015326.5, 13 pages, dated Mar. 28, 2016.

* cited by examiner

METHOD FOR OPERATING A FUEL INJECTION SYSTEM WITH PRESSURE REDUCTION, AND A FUEL INJECTION SYSTEM COMPRISING A FUEL INJECTION VALVE WITH A SERVO VALVE

CROSS-REFERENCE TO RELATED APPLICATIONS

This application is a U.S. National Stage Application of International Application No. PCT/EP2013/055519 filed Mar. 18, 2013, which designates the United States of America, and claims priority to DE Application No. 10 2012 204 252.0 filed Mar. 19, 2012, the contents of which are hereby incorporated by reference in their entirety.

TECHNICAL FIELD

The present invention relates to a method for operating a fuel injection system, which has a pressure reservoir (rail), at least one injection valve, in which a piezoelectric actuator actuates a servo valve arranged in a servo valve space counter to the force of a closing spring so that a closure element opens an injection opening connected to the pressure reservoir by a fuel line, and a feedforward and feedback control unit.

BACKGROUND

Fuel injection systems with which fuel injection into a combustion chamber of an internal combustion engine is performed have long been known. Injection systems of this kind comprise at least one injection valve (injector) and at least one feedforward and feedback control unit, connected to the injection valve, for controlling the injection process. Here, the injection valve has a space from which fuel can be injected into the combustion chamber through an injection opening. The opening and closing of the injection opening is performed by means of a closure element (nozzle needle), which can be actuated (moved) by an actuator. The space is supplied with fuel via a high-pressure reservoir and a fuel line.

The actuator is an element for moving the closure element. Thus, an injection process is controlled with the aid of the actuator. At the same time, the actuator is not in direct drive connection with the closure element but actuates a servo valve in order to discharge fuel under high pressure from a servo valve space and, in this way, to bring about actuation of the closure element and to open the associated injection opening.

The actuator is a piezoelectric actuator which expands (increases in length) by virtue of the piezoelectric effect when supplied with electrical energy and in this way raises the servo valve from its seat in order thereby to actuate the closure element.

In order to carry out a pressure reduction in the pressure reservoir (rail pressure reduction) in such fuel injection systems with piezoelectric servo injection valves, special pressure control valves (PLV, PCV, PDV) are used in prior art systems. These additional valves increase the costs of the overall system. In another procedure, a pilot-controlled servo valve is used in reducing the pressure in the pressure reservoir. With a pilot-controlled servo valve of this kind, however, it is not always possible to reduce the pressure in the pressure reservoir in the desired manner, and therefore it is nevertheless necessary to provide additional valves for pressure reduction, depending on customer requirements and the injection valve design.

SUMMARY

One embodiment provides a method for operating a fuel injection system of an internal combustion engine, which has a pressure reservoir, at least one injection valve, in which a piezoelectric actuator actuates a servo valve arranged in a servo valve space counter to the force of a closing spring so that a closure element opens an injection opening connected to the pressure reservoir by a fuel line, and a feedforward and feedback control unit, wherein the piezoelectric actuator used has a passive piezoelectric region as a force sensor in addition to the active piezoelectric region used to actuate the servo valve; the force acting on the passive piezoelectric region when the servo valve is opened, and, from said force, the pressure in the servo valve space, is determined with the aid of this force sensor, taking into account the closing spring force; and the active piezoelectric region is activated in such a way if a pressure reduction is required in the pressure reservoir that a pressure reduction occurs through the opening of the servo valve without a servo valve space pressure corresponding to opening of the closure element being reached during this process.

In a further embodiment, a pressure reduction is carried out in a phase in which no injection is taking place.

In a further embodiment, the limiting pressure Pst_limit in a control space for the closure element, which the pressure in the control space must not undershoot so as to avoid opening the closure element, is determined from the actual pressure in the pressure reservoir (rail pressure) Prail_ist.

In a further embodiment, the setpoint control space pressure P_st_s is determined in accordance with the setpoint rail pressure Prail_s and with the actual rail pressure Prail_ist and is limited in a downward direction by the limiting pressure Pst_limit in the control space.

In a further embodiment, the setpoint pressure for the valve space P_v_s is determined from the setpoint control space pressure P_st_s and the actual rail pressure Prail_ist.

In a further embodiment, the servo valve is moved by activating the active piezoelectric region until the actual valve space pressure P_v_ist has reached the setpoint pressure for the valve space P_v_s, after which the valve space pressure is adjusted to P_v_s by activating and deactivating the active piezoelectric region.

In a further embodiment, the fuel injection system has a plurality of injection valves, wherein, in the case in which the injection valve currently being used for pressure reduction is supposed shortly afterwards to carry out an injection process, other injection valves, which are currently not injecting, are used for the pressure reduction.

In a further embodiment, the pressure reduction is continued until the rail pressure reaches the setpoint thereof, after which the servo valve or the servo valves are closed again by discharging the piezoelectric actuator or piezoelectric actuators.

Another embodiment provides a fuel injection system for an internal combustion engine, which has a pressure reservoir, at least one injection valve, in which a piezoelectric actuator actuates a servo valve arranged in a servo valve space counter to the force of a closing spring so that a closure element opens an injection opening connected to the pressure reservoir by a fuel line, and a feedforward and feedback control unit, wherein it is configured to perform a method as described above.

In a further embodiment, the passive piezoelectric region is formed by an additional, serially arranged, passive piezoelectric layer.

BRIEF DESCRIPTION OF THE DRAWINGS

Example embodiments of the invention are explained in detail below with reference to the drawings, in which.

DETAILED DESCRIPTION

Figure 1:
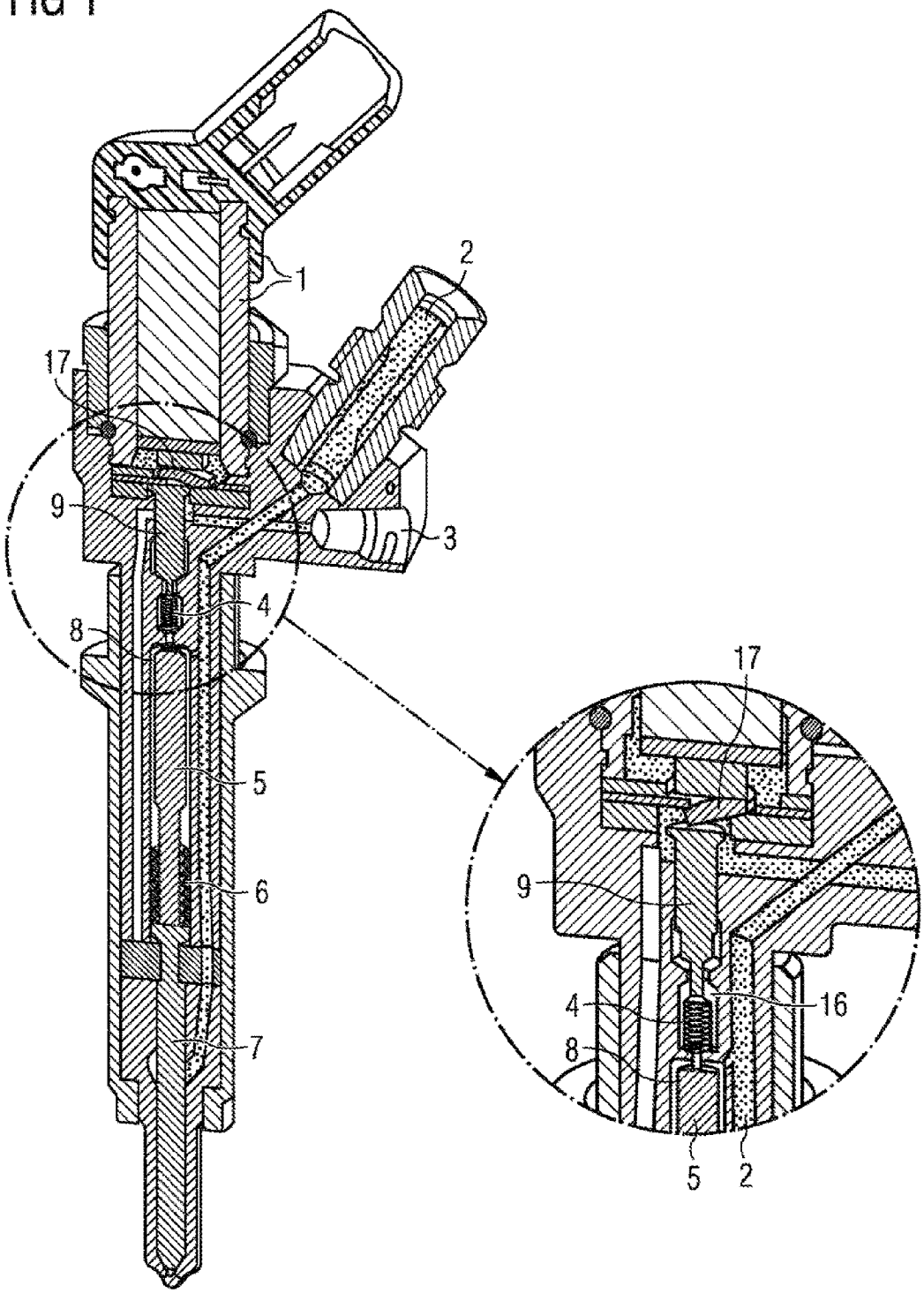
FIG. 1 shows a schematic longitudinal section through an injection valve with an enlarged detail of the region arranged in the circle.

Embodiments of the present invention provide a method for operating a fuel injection system at particularly low cost.

In some embodiments, the piezoelectric actuator used has a passive piezoelectric region as a force sensor in addition to the active piezoelectric region used to actuate the servo valve; the force acting on the passive piezoelectric region when the servo valve is opened, and, from said force, the pressure in the servo valve space, is determined with the aid of this force sensor, taking into account the closing spring force; and the active piezoelectric region is activated in such a way if a pressure reduction is required in the pressure reservoir that a pressure reduction occurs through the opening of the servo valve without a servo valve space pressure corresponding to opening of the closure element being reached during this process.

Aspects of the invention are based on the concept of adding a passive piezoelectric region to the active piezoelectric region of the actuator and using this passive piezoelectric region as a sensor for force measurement. When a pressure reduction is required, the servo valve is opened by activating the active piezoelectric region while simultaneously measuring the force on the piezoelectric sensor. From the force measurement, the pressure in the servo valve space is determined, taking into account the closing spring force. The opening of the servo valve brings about the desired pressure reduction, and the pressure reduction is controlled in such a way that a servo valve space pressure corresponding to opening of the closure element is not reached. The closure element therefore remains closed in the pressure reduction phase.

Thus, the rail pressure reduction is performed by the injection valve itself without the need for an additional pressure control valve or pressure reduction valve. It is thereby possible to carry out the disclosed method at particularly low cost.

In some embodiments, a pressure reduction is performed in a phase in which no injection is taking place. A pressure reduction phase therefore takes place before or after an injection phase, and, in the case of a plurality of injection valves, the pressure reduction can be distributed between different injection valves. Thus, in the case in which the injection valve currently being used for pressure reduction is supposed shortly afterwards to carry out an injection process, for example, other injection valves, which are currently not injecting, are used for the pressure reduction. There is therefore no need for the full pressure reduction to be carried out with a single injection valve; instead, this valve can be used to carry out just a part of the pressure reduction, while the remainder of the pressure reduction is taken over by the other injection valves.

In particular, in some embodiments of the method, the limiting pressure Pst_limit in a control space for the closure element, which the pressure in the control space must not undershoot so as to avoid opening the closure element, is determined from the actual pressure in the pressure reservoir (rail pressure) Prail_ist. It is sufficient here if the ratio of Pst_limit to Prail_ist is greater than a threshold.

The setpoint control space pressure P_st_s is determined in accordance with the setpoint rail pressure P_rail_s and with the actual rail pressure Prail_ist and is limited in a downward direction by the limiting pressure Pst_limit in the control space. If the pressure reduction gradient is supposed to be greater, a lower setpoint control space pressure is chosen.

The setpoint pressure for the valve space P_v_s is then determined from the setpoint control space pressure P_st_s and the actual rail pressure Prail_ist, the setpoint pressure for the valve space corresponding to a pressure which produces opening or a switching leakage of the servo valve without opening the closure element.

In this process, the servo valve is moved by activating the active piezoelectric region until the actual valve space pressure P_v_ist has reached the setpoint pressure for the valve space P_v_s, after which the valve space pressure is adjusted to P_v_s by activating and deactivating (charging and discharging) the active piezoelectric region.

The pressure reduction (rail pressure reduction) carried out by the disclosed method using one or more injection valves is continued until the rail pressure reaches the setpoint thereof, after which the servo valve or the servo valves are closed again by discharging the piezoelectric actuator or piezoelectric actuators.

Other embodiments provide a fuel injection system for an internal combustion engine, which has a pressure reservoir (rail), at least one injection valve, in which a piezoelectric actuator actuates a servo valve arranged in a servo valve space counter to the force of a closing spring so that a closure element opens an injection opening connected to the pressure reservoir by a fuel line, and a feedforward and feedback control unit. This fuel injection system is configured to perform a method of the type described above.

In particular, the passive piezoelectric region acting as a force sensor is formed by an additional, serially arranged, passive piezoelectric layer.

The drive connection between the piezoelectric actuator and the closure element is preferably designed in such a way that the piezoelectric actuator is connected by a multiplication lever to a control piston which opens and closes the servo valve and thus brings about the desired pressure reduction.

Here, the servo valve is opened counter to the force of a closing spring and is situated in a servo valve space which is connected via a restrictor to a control space which is connected to the fuel line and accommodates the closure element or a piston for the closure element. When the servo valve is opened, the pressure in the servo valve space and hence the rail pressure is thus reduced in a controlled manner.

FIG. 1 shows, in a schematic way, an injection valve used, for example, in a diesel engine for a passenger vehicle. It is used to inject fuel into a combustion chamber of an internal combustion engine. It has a space which is connected by a fuel line (high-pressure line) 2 to a pressure reservoir (high-pressure reservoir) (rail). The injection valve illustrated here is one of a multiplicity of injection valves which are each connected in a common rail system to the same pressure reservoir by fuel lines. At the bottom end of the injection valve, said valve has an injection opening, through which fuel can be injected from the space into the combustion chamber. Arranged in the space is a nozzle needle 7 serving as a closure element, by means of which the injection opening can be opened and closed. When the nozzle needle 7 is in an open position, in which it exposes the injection opening, fuel under high pressure is injected from the space into the combustion chamber. In a closed position of the nozzle needle 7, in which the nozzle needle closes the injection opening, injection of fuel into the combustion chamber is prevented.

The nozzle needle 7 is controlled by means of a piezoelectric actuator 1. Depending on activation, the piezoelectric actuator 1 can change in length and exert a force via a multiplication lever 17 on a control piston 9, the latter making contact with a servo valve 4, which is pressed against a valve seat by way of a closing spring. The servo valve 4 is arranged in a valve space 16 which is connected via a restrictor to a control space 8 for the closure element. The control space 8 accommodates a piston 5, which actuates the nozzle needle 7.

When the piezoelectric actuator 1 is supplied with electrical energy (charged), it increases in length and thereby causes the control piston 9 to raise the servo valve 4 from the seat thereof, with the result that the pressure prevailing in the servo valve space 16 is reduced. Owing to this pressure reduction, the needle piston 5 and the nozzle needle 7 move upward in the figure and, in the process, expose the injection opening to enable an injection process to be carried out.

In addition, the opening of the servo valve 4 brings about a pressure reduction process without opening the nozzle needle 7 in order to achieve a rail pressure reduction. During this process, the servo valve 4 is opened only to the extent that, although a controlled pressure reduction takes place, the closure element or nozzle needle 7 does not open.

FIG. 1 furthermore shows a fuel return 3 and a closing spring 6 for the nozzle needle 7.

In addition to the active piezoelectric region 12 used to actuate the nozzle needle 7, the piezoelectric actuator 1, which is illustrated only schematically in FIG. 1, has a passive piezoelectric region 13 as a force sensor. With the aid of this force sensor, the force acting on the piezoelectric actuator via the control piston 9 and the multiplication lever 17 is determined.

Figure 2:
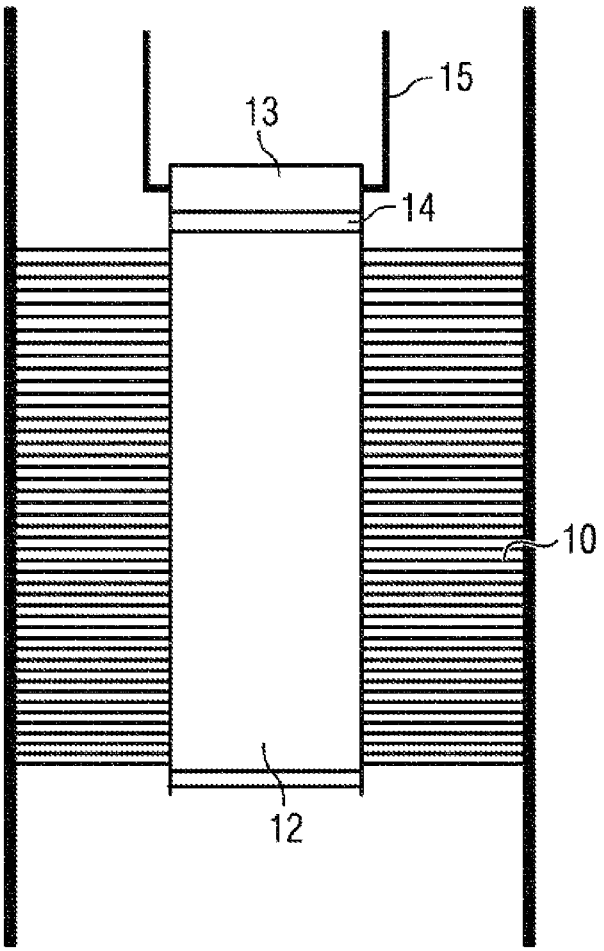
FIG. 2 shows a schematic partial longitudinal section through a piezoelectric actuator with a force sensor.

FIG. 2 shows schematically the construction of the piezoelectric actuator 1, which forms a constructional unit that has the active piezoelectric region 12 for actuating the nozzle needle 7 and the passive piezoelectric region 13, which serves as a force sensor. The active piezoelectric region 12 includes a multiplicity of active piezoelectric layers arranged one above the other, which have respective corresponding connection electrodes 10 on the left and on the right. Arranged on the topmost active piezoelectric layer, isolated by suitable insulation 14, is a passive piezoelectric layer, which forms the piezoelectric region 13 acting as a force sensor. The passive piezoelectric layer is provided on both sides with corresponding connection electrodes 15.

Figure 3:
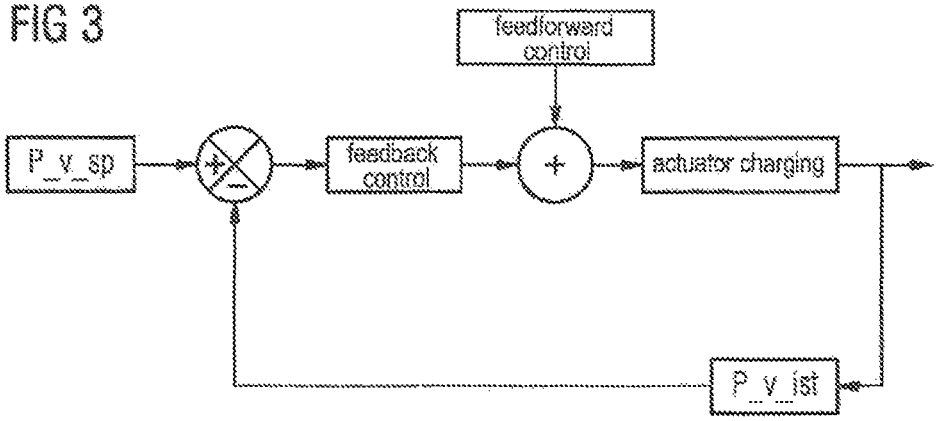
FIG. 3 shows the principle involved in controlling the pressure reduction.

FIG. 3 shows the principle of the controlled pressure reduction carried out with the injection valve in a block diagram. In a pressure reduction phase, in which the rail pressure is to be reduced, the servo valve 4 is opened. At the same time, the force exerted on the piezoelectric actuator and hence the pressure prevailing in the servo valve space 16 is determined by means of the passive piezoelectric region, taking account of the force of the closing spring of the servo valve. The actual pressure determined in the servo valve space P_v_ist is compared with a setpoint pressure P_v_sp, and the actuator charge is varied until the setpoint pressure is achieved. This setpoint pressure corresponds to a pressure which brings about the desired pressure reduction but does not lead to opening of the closure element.

Figure 4:
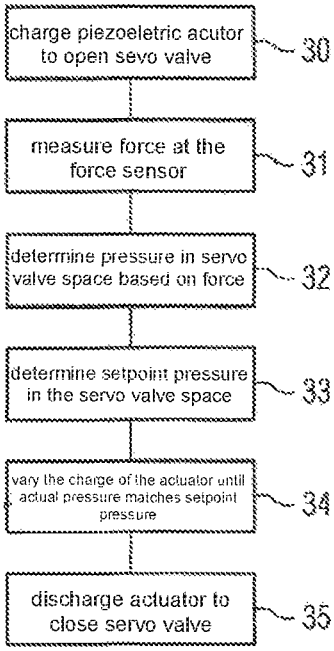
FIG. 4 shows a sequence diagram illustrating the control of the pressure reduction.

FIG. 4 shows a sequence diagram of the individual method steps. In step 30, the piezoelectric actuator is charged in order to open the servo valve 4. As the servo valve is opened, the force is measured at the force sensor, which is formed by the passive piezoelectric region, in accordance with step 31. By means of the measured force, the pressure in the servo valve space is measured in accordance with step 32. In step 33, a setpoint pressure in the servo valve space is determined, corresponding to a pressure at which the closure element does not open. According to step 34, the charge of the piezoelectric actuator is varied until the actual pressure in the valve space has achieved the setpoint pressure in the valve space. When the desired rail pressure reduction has taken place, the servo valve is closed again by discharging the piezoelectric actuator in accordance with step 35.

What is claimed is:

1. A method for operating a fuel injection system of an internal combustion engine having a pressure reservoir, at least one injection valve in which a piezoelectric actuator actuates a servo valve counter to the force of a closing spring tending to hold the servo valve closed, the servo valve arranged in servo valve space connected to a control space for a closure element through a restrictor, so actuating the servo valve adjusts the pressure in the servo valve space and the connected control space for the closure element, the servo valve operable to reduce the pressure to an activation pressure moving the closure element and thereby opening an injection opening connected to the pressure reservoir by a fuel line, and a feedforward and feedback control unit, the method comprising:

using an active piezoelectric region of the piezoelectric actuator to actuate the servo valve, the active piezoelectric region including a multiplicity of active piezoelectric layers arranged serially and respective connection electrodes for each of the multiplicity of active piezoelectric layers;

using a passive piezoelectric region of the piezoelectric actuator as a force sensor, the passive piezoelectric region including at least one layer with respective connection electrodes, the at least one layer isolated from the multiplicity of active piezoelectric layers by a layer of insulation;

using the force sensor to determine a force acting on the passive piezoelectric region when the servo valve is opened, the determination of the force taking into account the force applied by the closing spring against the servo valve;

determining a pressure in the servo valve space based on the determined force acting on the passive piezoelectric region;

when a pressure reduction is required in the pressure reservoir, adjusting the servo valve to reduce the pressure in the servo valve space by activating the active piezoelectric region until an actual valve space pressure has reached a setpoint pressure above the activation pressure, the setpoint pressure not sufficient to move the closure element, and subsequently deactivating the active region of the piezoelectric actuator.

2. The method of claim 1, wherein the pressure reduction is performed in a phase in which no injection is taking place.

3. The method of claim 1, wherein the activation pressure, which the pressure in the control space must not undershoot so as to avoid opening the closure element, is determined from the actual pressure in the pressure reservoir (rail pressure) Prail_ist.

4. The method of claim 3, wherein the setpoint pressure is determined in accordance with a setpoint rail pressure and with an actual rail pressure and is limited in a downward direction by a limiting pressure in the control space.

5. The method of claim 4, wherein the setpoint pressure for the valve space is determined from the setpoint control space pressure and the actual rail pressure.

6. The method of claim 1, wherein the fuel injection system has a plurality of injection valves, and wherein, the performance of the pressure reduction is transferred from a first injection valve to one or more other injection valves based on a scheduled injection process for the first injection valve.

7. The method of claim 1, wherein the pressure reduction is continued until the rail pressure reaches a setpoint pressure, after which the servo valve or the servo valves are closed again by discharging the piezoelectric actuator or piezoelectric actuators.

8. A fuel injection system for an internal combustion engine, comprising:

a pressure reservoir, at least one injection valve in which a piezoelectric actuator actuates a servo valve counter to the force of a closing spring tending to hold the servo valve closed, the piezoelectric actuator comprising:

an active piezoelectric region including a multiplicity of active piezoelectric layers arranged serially and respective connection electrodes for each of the multiplicity of active piezoelectric layers; and a passive piezoelectric region of the piezoelectric actuator including at least one layer with respective connection electrodes, the at least one layer isolated from the multiplicity of active piezoelectric layers by a layer of insulation;

the servo valve arranged in a servo valve space connected to a control space for a closure element through a restrictor, wherein actuating the servo valve reduces a pressure in the servo valve space and the control space, the control space having an activation pressure, wherein the servo valve is operable to reduce the pressure in the control space to the activation pressure, thereby opening an injection opening connected to the pressure reservoir by a fuel line, and a feedforward and feedback control unit, wherein the fuel injection system is configured to:

use the active piezoelectric region of the piezoelectric actuator to actuate the servo valve;

use the passive piezoelectric region of the piezoelectric actuator as a force sensor;

use the force sensor to determine a force acting on the passive piezoelectric region when the servo valve is opened, the determination of the force taking into account a closing spring force applied by the closing spring against the servo valve;

determine a pressure in the servo valve space based on the determined force acting on the passive piezoelectric region; and when a pressure reduction is required in the pressure reservoir, activate the active piezoelectric region to open the servo valve to reduce the pressure in the servo valve space to a setpoint control space pressure but without reaching the activation pressure corresponding to an opening of the closure element and subsequently deactivating the active piezoelectric region.

9. The fuel injection system of claim 8, wherein the pressure reduction is performed in a phase in which no injection is taking place.

10. The fuel injection system of claim 8, wherein the activation pressure is determined from an actual pressure in the pressure reservoir.

11. The fuel injection system of claim 10, wherein the setpoint control space pressure is determined in accordance with a setpoint rail pressure and with an actual rail pressure and is limited in a downward direction by the activation pressure.

12. The fuel injection system of claim 11, wherein a setpoint pressure for the valve space is determined from the setpoint control space pressure and the actual rail pressure.

13. The fuel injection system of claim 8, wherein the servo valve is moved by activating the active piezoelectric region until an actual valve space pressure has reached a setpoint pressure for the valve space, after which the valve space pressure is adjusted to the setpoint pressure by activating and deactivating the active piezoelectric region.

14. The fuel injection system of claim 8, wherein the fuel injection system has a plurality of injection valves, and wherein, the performance of the pressure reduction is transferred from a first injection valve to one or more other injection valves based on a scheduled injection process for the first injection valve.

15. The fuel injection system of claim 8, wherein the pressure reduction is continued until the rail pressure reaches a setpoint rail pressure, after which the servo valve or the servo valves are closed again by discharging the piezoelectric actuator or piezoelectric actuators.

* * * * *